US006237524B1

(12) United States Patent
Andrew

(10) Patent No.: US 6,237,524 B1
(45) Date of Patent: May 29, 2001

(54) POSITION FLAG FOR MANUALLY USABLE MEANS

(75) Inventor: Robert D. Andrew, Dundee (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/071,613

(22) Filed: May 1, 1998

(30) Foreign Application Priority Data

Jun. 28, 1997 (GB) ..... 9713626

(51) Int. Cl.[7] ..... G01B 21/00; G01D 13/22
(52) U.S. Cl. ..... 116/205; 116/209; 434/113
(58) Field of Search ..... 116/205, 200, 116/1, 201, 209, 280, 307; 434/112, 113, 114, 115; 379/52; 704/271; 400/87; 454/121; 219/209; 392/379; 222/2

(56) References Cited

U.S. PATENT DOCUMENTS

| | | | | |
|---|---|---|---|---|
| 3,563,358 | * | 2/1971 | Lindeberg | 194/241 |
| 4,092,907 | * | 6/1978 | Meyer et al. | 454/154 |
| 4,762,169 | * | 8/1988 | Andersen et al. | 165/203 |
| 5,185,515 | | 2/1993 | Nishibe . | |
| 5,234,032 | * | 8/1993 | Kline et al. | 137/884 |
| 5,318,164 | * | 6/1994 | Barnes et al. | 194/200 |
| 5,407,330 | * | 4/1995 | Rimington et al. | 417/312 |
| 5,412,189 | | 5/1995 | Cragun . | |
| 5,616,901 | | 4/1997 | Crandall . | |
| 5,785,204 | * | 7/1998 | Thompson et al. | 221/24 |

FOREIGN PATENT DOCUMENTS

| | | |
|---|---|---|
| 0535417 | 4/1993 | (EP) . |
| 0720131 | 7/1996 | (EP) . |

* cited by examiner

*Primary Examiner*—Andrew H. Hirshfeld
*Assistant Examiner*—R Alexander Smith
(74) *Attorney, Agent, or Firm*—Gregory A. Welte

(57) ABSTRACT

The present invention relates to a method and apparatus for flagging the position of manually usable means (11,14) in a manually operable device (10). In order to guide a user to the location of manually usable means (11,14) which require to be manually actuated or to on or from which items require to manually entered or removed, the invention provides an air supply (17) and one or more nozzles connected to the air supply (17) to provide one or more jets of air. The nozzles (16) are stationed and directed such that a user of the device (10) can sense the position and direction of the air jet or jets so as to find the position of the manually usable means (11,14). The invention can be used to help those who may have a visual impairment to operate an automatic teller machine. The different areas of the machine can be found from air jets which come from the nozzles (16) stationed at the different areas of the machine, such areas including a card entry slot (11), a keyboard (14) and a cash dispensing slot (13). The invention can also be applied to help locate manually usable areas of other machines such as vending machines.

4 Claims, 1 Drawing Sheet

POSITION FLAG FOR MANUALLY USABLE MEANS

BACKGROUND OF THE INVENTION

The present invention relates to a method and apparatus for flagging the position of manually usable means in a manually operable device such as a self service machine.

It has become commonplace for customers requiring banking services to make use of automated teller machines (ATMs) to obtain cash or to deposit funds. Similarly customers for food and beverages frequently make use of self service dispensing machines to obtain the supplies they require. Whilst such machines have been successful for the majority of customers and in the majority of circumstances, there remains a problem for individuals who may be visually impaired or who may have to use a machine in conditions where the light levels are inadequate. In such cases the interaction between the user and the machine may result in an unsatisfactory operation of the machine because of the physical difficulty of identifying and locating manually usable portions of the machine such as the keys of a keyboard or a slot for the reception of magnetic cards or for the dispensing of cash or receipts.

SUMMARY OF THE INVENTION

It is an object of the present invention to facilitate the physical location of manually usable means included in a manually operable device.

According to one aspect of the present invention there is provided a method of indicating the position of a manually usable means included in a manually operable device, characterized by supplying air from an air supply to at least one air nozzle which is associated with said manually usable means and which when activated projects a jet of air which serves as a tactile flag as regards the position of said manually usable means.

According to another aspect of the present invention there is provided a self service machine including at least one manually usable means, characterized by at least one air jet flag means associated with a manually usable means, said at least one flag means comprising at least one air nozzle which is connectable to an air supply and which when activated projects a jet of air which serves as a tactile flag as regards the position of the associated manually usable means.

BRIEF DESCRIPTION OF THE DRAWINGS

The invention will now be described, by way of example, with reference to the accompanying drawings in which.

DETAILED DESCRIPTION

Figure 1:
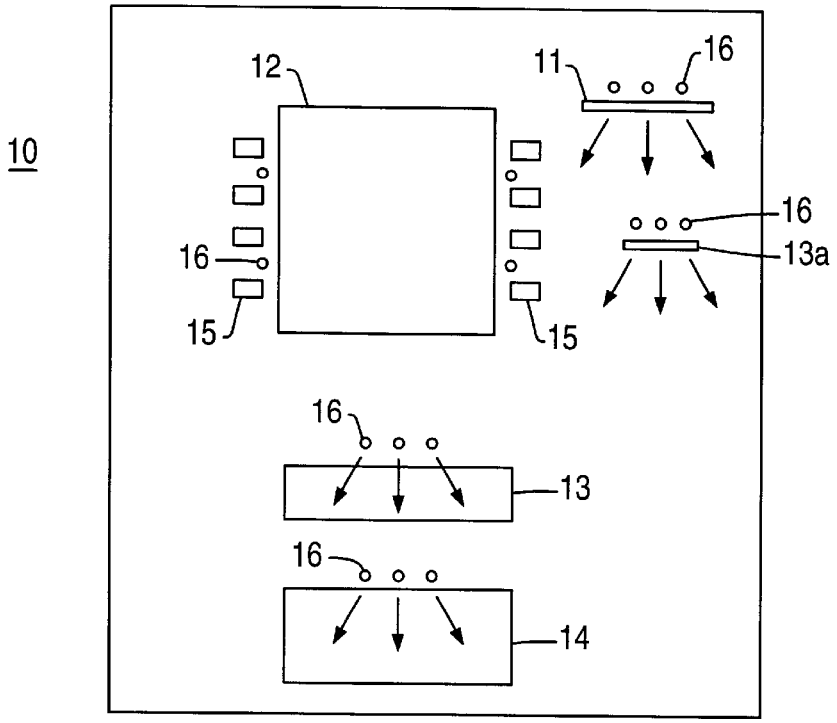
FIG. 1 shows an automatic teller machine embodying the present invention.

Referring to FIG. 1, there is shown an ATM 10 which includes a card entry slot 11, a visual display screen 12, a cash dispensing slot 13, a receipt dispensing slot 13*a*, and a keyboard 14. The ATM 10 operates in a manner familiar to those in the art to receive a user identification magnetic card in the card slot 11 and thereupon to display on the visual display screen 12 a request for the entry by the user of a personal identification number (PIN) by means of the keyboard 14. In response to the correct entry of the PIN associated with the magnetic card, the display screen 12 presents a menu of options available to the user. In addition, the ATM 10 includes audio means (not shown) for providing audible instructions to a user who may be visually impaired. The user may opt to receive cash in an amount entered either via the keyboard 14 or by way of two sets of selection keys 15 located on each side of the display screen 12. The transaction is completed by the presentation of the requested cash at the cash dispensing slot 13, and the presentation of a receipt at the receipt dispensing slot 13*a*.

The ATM 10 thus requires the user to physically locate each of a number of manually usable means positioned at locations around the ATM 10 in the required sequence so as to complete a successful transaction. In the ATM 10, the manually usable means include, firstly, the card entry slot 11 and associated mechanism which registers the entry of the magnetic card. The manual use in this case is the physical entry by the user of the card into the card slot 11. The manually usable means also include the keyboard 14 and the keys 15 and in this case the manual actuation is the operation of one or more keys. Finally, the manually usable means include the cash dispensing slot 13 from which the dispensed cash has to be manually removed to signal to the machine 10 that the cash has been successfully dispensed, and the receipt dispensing slot 13*a* from which the receipt has to be manually removed to signal that the receipt has been successfully dispensed.

Positioned closely adjacent to the card entry slot 11 are a first set of three air nozzles 16. The cash dispensing slot 13 and the receipt dispensing slot 13*a* each has a set of three more air nozzles 16 positioned adjacent to it. The keyboard 14 also has a set of three nozzles 16 positioned adjacent to it, and each of the sets of keys 15 has two air nozzles 16 physically associated therewith.

Figure 2:
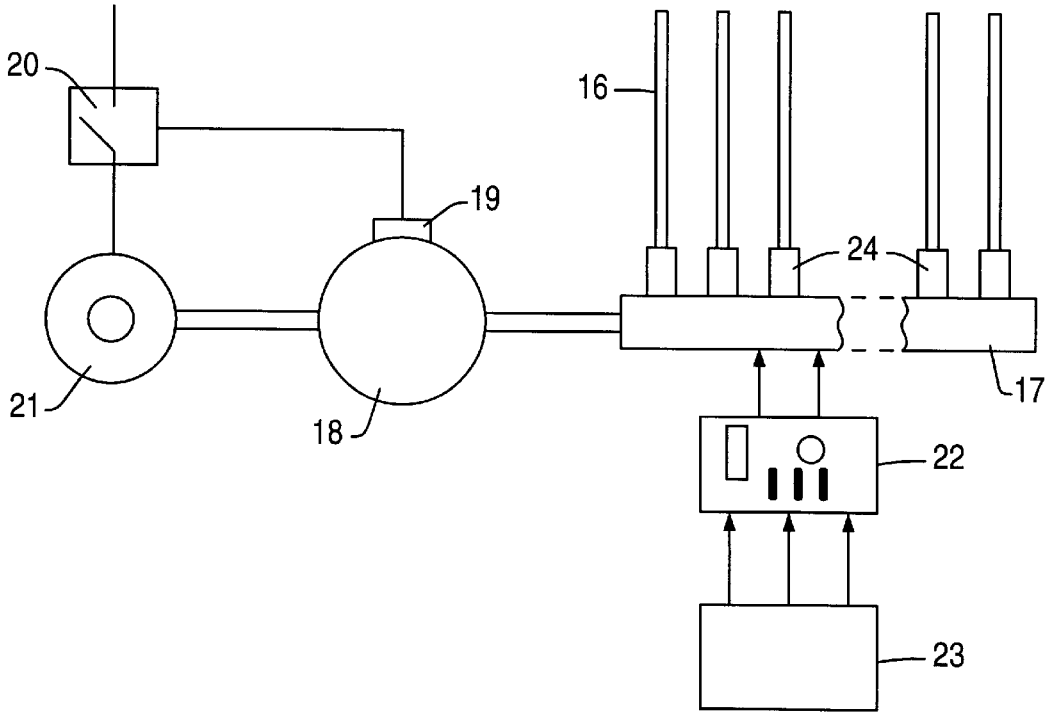
FIG. 2 shows a pneumatic position flagging system forming a part of the machine of FIG. 1.

Referring now to FIG. 2, the nozzles 16 are shown diagrammatically as part of a pneumatic control system incorporated into the machine 10. The nozzles 16 are positioned in communication with an air supply chamber 17 via respective solenoid operated valves 24, the chamber 17 being supplied with air from an air reservoir 18. The air reservoir 18 has a pressure sensing switch 19 which is connected to operate an electrical supply switch 20 connected between a supply of electrical power and an air pump 21. The air pump 21 is thereby controlled through the automatic actuation of the pressure sensing switch 19 and the electrical switch 20 to maintain the air pressure in the reservoir 18 within a preset range of pressures.

The solenoid operated valves 24 control the flow of air from the reservoir 17 into the nozzles 16. The valves 24 are electrically operated by means of a control circuit board 22 which receives an indication of the modes of operation of the ATM 10 from electronic control means 23.

In use, the ATM 10 starts in an idle mode awaiting use by a customer. In the idle mode, the air nozzles 16 at the card entry slot 11 are activated by means of the respective control valves 24, while the rest of the nozzles 16 are inactivated. The activated nozzles 16 supply jets of air directed so as to intercept the location where a user would be expected to stand in using the ATM 10. The user is thereby enabled to feel the air jets which thus act as a tactile flag which can be followed by a hand of the user to a position closely adjacent to the card entry slot 11.

After the successful entry of a magnetic card into the card entry slot 11, the electronic control means 23 initiates the next mode of operation requiring entry by the user of the associated PIN. The electronic control means 23 supplies the appropriate mode signals to the control card 22 which switches the control valves 24 to activate those nozzles 16 associated with the keyboard 14 and to deactivate the nozzles 16 associated with the card entry slot 11. The user is thus directed to the keyboard 14 by means of the air jets issuing from the nozzles 16 adjacent to the keyboard 14, the air jets in this case acting as a tactile flag as regards the position of the keyboard 14.

Following successful entry of the correct PIN via the keyboard 14, the electronic control means 23 initiates the next mode of operation in which the ATM 10 offers the user a menu of options through the display screen 12 or through the audio means (not shown). The electronic control means 23 supplies control signals to the control card 22 which switches the control valves 24 to select a supply of air to those nozzles 16 associated with the selection keys 15.

After the successful entry of a selection from the menu of operations including the entry of a requested amount of cash to be dispensed, the nozzles 16 associated with the keyboard 14 and the selection keys 15 are deactivated, and the electronic control means 23 initiates the next mode of operation in which first the customer card is returned to the card entry slot 11 and, following retrieval of the card, cash is dispensed at the cash dispensing slot 13, after which a receipt is presented at the receipt slot 13 for removal by the user. In the course of these last mentioned modes of operation, the electronic control means 23 sends signals to the control card 22 which operates the solenoid valves 24 so as firstly to select the nozzles 16 associated with the card dispenser slot 11 and subsequently to deactivate the last mentioned nozzles 16 and activate the nozzles 16 associated with the cash dispenser slot 13. Next, after cash presented at the slot 13 has been removed, the nozzles 16 associated with the slot 13 are deactivated and the nozzles 16 associated with the receipt dispensing slot 13*a* are activated so as to guide the user to the slot 13*a* from which the presented receipt is removed. Finally, the nozzles 16 associated with the slot 13*a* are deactivated, and the nozzles 16 associated with the card slot 11 are activated, the ATM 10 now being back in its idle condition.

Each set of nozzles 16 at the card entry slot 11, the cash dispensing slot 13, the receipt dispensing slot 13*a* and the keyboard 14 provide a spread of outwardly diverging air jets to be felt by the user. While a set of three air jets have been illustrated at each of these stations, the number of jets at each station may be more or less than three. A single air jet at each station may be sufficient. A set of three air jets at each station will enable a user to become rapidly oriented relative to that station and therefore to the whole ATM 10.

In an alternative type of automatic teller machine for use in depositing funds, air nozzles such as the nozzles 16 may be stationed and directed to guide the user through a sequence of operations including the entry of a card into a card entry slot, the entry of a PIN through the keys of a keyboard, the deposit of an envelope through a deposit entry slot, and the acceptance of a receipt from a receipt dispensing slot.

The control card 22 may selectively operate the control valves 24 to pass air through each selected nozzle 16 as a constant stream forming the air jet from that nozzle 16. The control card 22 may alternatively pulse the valves 24 of the selected nozzles 16 so that each selected nozzle passes a pulsed stream of air forming the air jet from that nozzle 16. The control card 22 may be used in one mode to control the valve 24 of a selected nozzle 16 to pass a constant stream of air while in another mode to pulse the valve 24 of the selected nozzle 16. The choice of either a constant or a pulsed stream of air may thus be used to signal different information to the user, for example to indicate a choice between two keys or areas or just to indicate that a new interface area is trying to attract the attention of the user and guide the user to the next station on the machine.

The invention has been particularly described in relation to guiding a user to different stations of operation on an automatic teller machine. The invention is not limited to such machines and may be applied to guiding a user to operate manually usable means on other machines. For example the invention is applicable to guiding a user to different stations of a vending machine where the user must insert cash into a cash entry slot, subsequently enter through a keyboard a choice of goods to be dispensed and finally collect the dispensed goods from a collection area.

What is claimed is:

1. A system comprising:

a) a self-service machine which
   i) dispenses articles at a dispensing station and
   ii) receives payment at a payment station;

b) a supply of pressurized air; and c) nozzles for delivering a first jet of pressurized air at the payment station and a second let at the dispensing station, wherein the first jet is delivered prior to delivery of the second jet.

2. A system comprising:

a) a self-service machine which
   i) dispenses articles at a dispensing station and
   ii) receives payment at a payment station;

b) a supply of pressurized air;

c) nozzles for delivering a first jet of pressurized air at the payment station and a second jet at the dispensing station; and d) a control means for causing the first jet to issue, then terminate, and then the second jet to issue.

3. A system, comprising:

an automated teller machine which includes:

a) a card entry slot;

b) a cash dispensing slot;

c) a keyboard;

d) a supply of pressurized air;

e) a first nozzle for delivering a jet of pressurized air adjacent to the card entry slot;

f) a second nozzle for delivering a jet of pressurized air adjacent to the cash dispensing slot; and g) a third nozzle for delivering a jet of pressurized air adjacent to the keyboard, and wherein said supply of pressurized air provides air for said jets.

4. A system according to claim 3, and further comprising:

h) a control system for causing the first, second, and third nozzles to issue their respective jets in a sequence.

* * * * *